US006764330B1

(12) United States Patent
Chen

(10) Patent No.: US 6,764,330 B1
(45) Date of Patent: Jul. 20, 2004

(54) FASTENING MECHANISM FOR ADAPTER CARD

(75) Inventor: Kuei-Hua Chen, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 10/600,441

(22) Filed: Jun. 23, 2003

(51) Int. Cl.[7] ..... H01R 13/62
(52) U.S. Cl. ..... 439/325
(58) Field of Search ..... 439/325–328, 439/352, 350, 357, 260, 786, 820, 834, 836–837, 858, 861, 159–160

(56) References Cited

U.S. PATENT DOCUMENTS 6,149,450 A * 11/2000 Gastineau ..... 439/325
6,168,450 B1 * 1/2001 Davis et al. ..... 439/327
6,431,890 B1 * 8/2002 Li et al. ..... 439/160
6,609,919 B2 * 8/2003 Ito et al. ..... 439/159

* cited by examiner

*Primary Examiner*—J. F. Duverne
(74) *Attorney, Agent, or Firm*—Bacon & Thomas PLLC

(57) ABSTRACT

The present invention is to provide a parallel arrangement of adapter cards with respect to a motherboard in installing the adapter cards in a computer case and to configure the adapter cards exposed on the computer case to be flat with an expansion plate provided on one side of the computer case by eliminating any recess on the computer case. As such, a user can easily, quickly plug a cable in a connector of the adapter card or unplug the same because sufficient space is provided. As a result, other cables coupled to adjacent connectors will always maintain good connection during the plugging or unplugging process.

5 Claims, 4 Drawing Sheets

FASTENING MECHANISM FOR ADAPTER CARD

FIELD OF THE INVENTION

The present invention relates to adapter card fastening and more particularly to an improved mechanism for fastening an adapter card in a computer case.

BACKGROUND OF THE INVENTION

The world we are living in has entered into a new era with information prosperously being developed. All kinds of information products are invented due to the fast progress in computer science and technology. The fast development of the new products not only shortens time required for communication between people in different geographical areas, but also greatly, advantageously influences our daily life and work. Thus, it is impossible of doing without them. In response to all kinds of new information products being developed, advanced associated computer components (e.g., computer cases and fastening mechanisms for adapter cards) are also available in an even faster pace. Thus, whether computer peripherals produced in the future can provide a more convenient and effective characteristic will be an indicator to decide whether the information technology owned by one country is more advanced than other countries.

Conventionally, expansion slots for coupling to adapter cards are provided on a motherboard in a computer case. Various types of expansion slots have been developed such as AGP, PCI, ISA, CNR, and AMR expansion slots. At present, for an ATX motherboard at least 5 PCI expansion slots are provided thereon. Typically, the higher of the number of expansion slots the higher expansion capability of a computer will be. In this regard, almost all major electronics companies continuously spend great money and effort in developing new adapter cards and expansion slots for meeting the increasing demand of vast consumers. Unfortunately, there is little progress in the improvement of mechanisms for fastening an adapter card in the computer case.

A typical mechanism for fastening an adapter card 6 in the computer is shown in FIG. 1 in which the adapter card 6 is threadably secured. In detail, a motherboard is provided in a computer case 7. A plurality of expansion slots 71 are formed on the motherboard. Each slot 71 is adapted to couple to the adapter card 6. The adapter card 6 comprises a metal bracket 60. A circuit board is formed at one end of the bracket 60 and a connector is formed at the other end thereof. One end of the bracket 60 is bent outward about 90 degrees to form a connection member 62. The connection member 62 has a cavity at one side.

Also, a bezel 8 is formed on a side of the case 7. The bezel 8 is faced the slots 71. The bezel 8 comprises a recess on an outer surface at one side of the case 7. The bezel 8 has a plurality of longitudinal openings 81. Each of the openings 81 corresponds to one of the slots 71. A threaded hole 82 is formed between any two adjacent openings 81. After the adapter cards 6 have been inserted in the slots 71, the brackets 60 are abutted on the openings 81. The connectors of the adapter cards 6 are thus projected from the openings 81 into the recess of the bezel 8. Further, the connection members 62 are rested on top of the bezel 8. Next, a plurality of screws 83 are employed to drive through the cavities and the threaded holes 82 for fastening the adapter cards 6 in the case 7.

But all prior mechanisms for fastening an adapter card in the computer case, particularly the above thread secureness, are unsatisfactory for the purpose for which the invention is concerned for the following reasons: It is time consuming, labor intensive, and inconvenience in assembly. Hence, users will be discouraged by the tedious process of replacing a malfunctioned adapter card or installing a new one in the computer if no effective means of fastening the adapter card is proposed in a near future. To the worse, users may lower his/her desires in buying adapter cards in the future, resulting in a slow of adapter card market growth. This may have a disastrous effect. Moreover, the adapter cards are disposed perpendicular to the case for saving precious space in the case. However, this can prohibit a significant reduction in the height of the case. In addition, a user may experience a great inconvenience in plugging a cable in the connector or unplugging the same because the connector is disposed in the recess of the bezel. To the worse, other cables coupled to adjacent connectors may be disconnected if sufficient care is not taken during the plugging or unplugging process.

In another aspect, high technology companies must not only maintain high quality of products but also increase assembly speed for meeting the vast market of computer assembly. As such, a speed increase in the assembly line, particularly the speed increase in fastening adapter cards in computer, is one of the most important factors in increasing the computer production. Additionally, developing multifunctional, powerful, and ergonomic personal computers is the trend among major computer manufacturers. Hence, a computer having many attractive features can not only bring a great convenience to vast consumers but also bring many business opportunities to the computer manufacturers. This is a task that has to be done immediately by computer manufacturers for surviving in the competitive information product market.

SUMMARY OF THE INVENTION

One object of the present invention is to change the prior mechanism for fastening adapter cards in a computer case for greatly reducing the size of the computer case. In brief, the technique of the present invention involves a parallel arrangement of adapter cards with respect to a motherboard in installing the adapter cards in a computer case.

Another object of the present invention is to configure the adapter cards exposed on the computer case to be flat with an expansion plate provided on one side of the computer case by eliminating any recess on the computer case. As such, a user can easily, quickly plug a cable in a connector of the adapter card or unplug the same because sufficient space is provided. As a result, other cables coupled to adjacent connectors will always maintain good connection during the plugging or unplugging process.

The above and other objects, features and advantages of the present invention will become apparent from the following detailed description taken with the accompanying drawings.

DETAILED DESCRIPTION OF THE PREFERRED EMBODIMENTS

Figure 1:
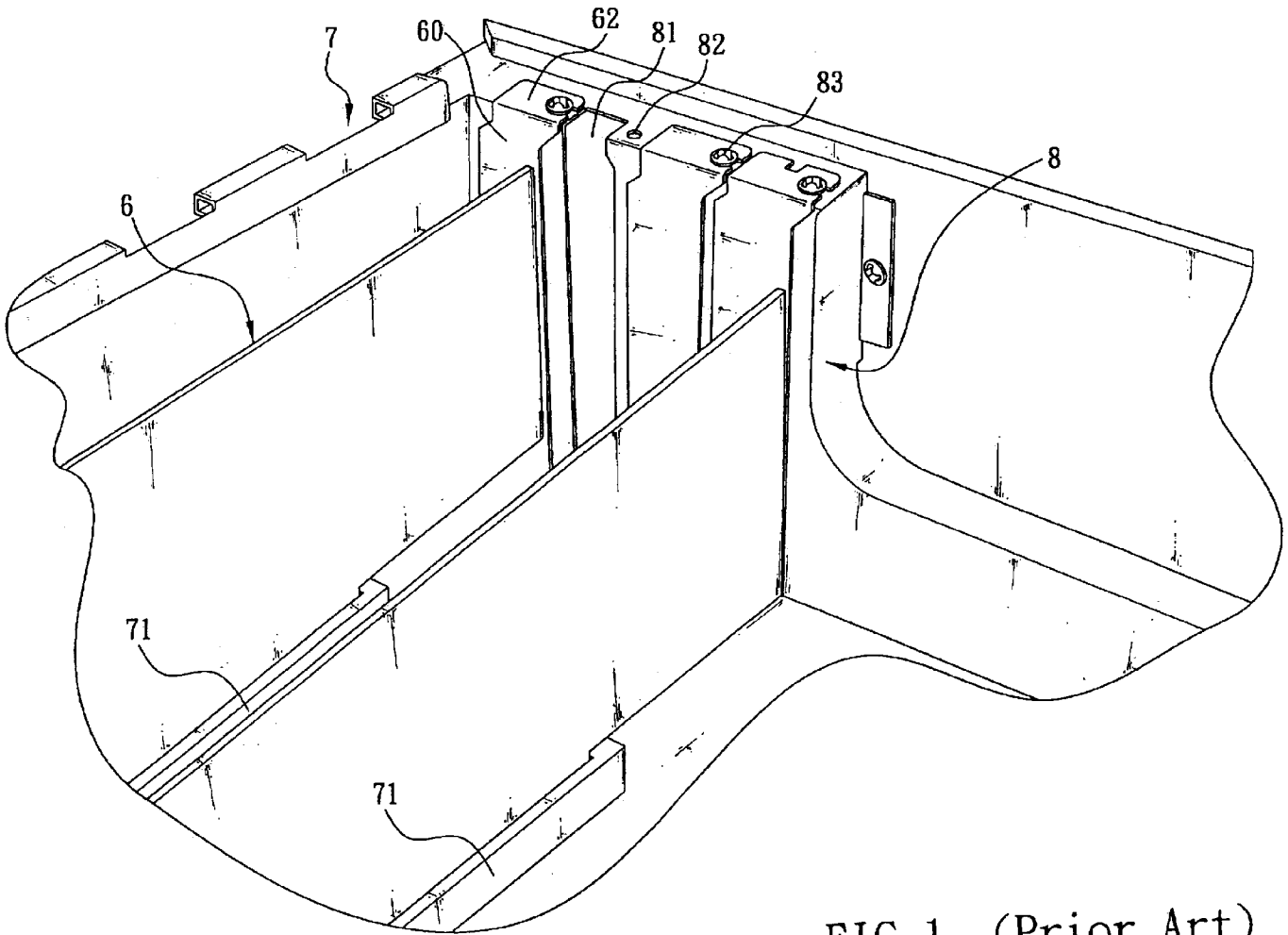
FIG. 1 (Prior Art)
FIG. 1 is a perspective view depicting a fastening of adapter cards in expansion slots of a computer case.
Figure 2:
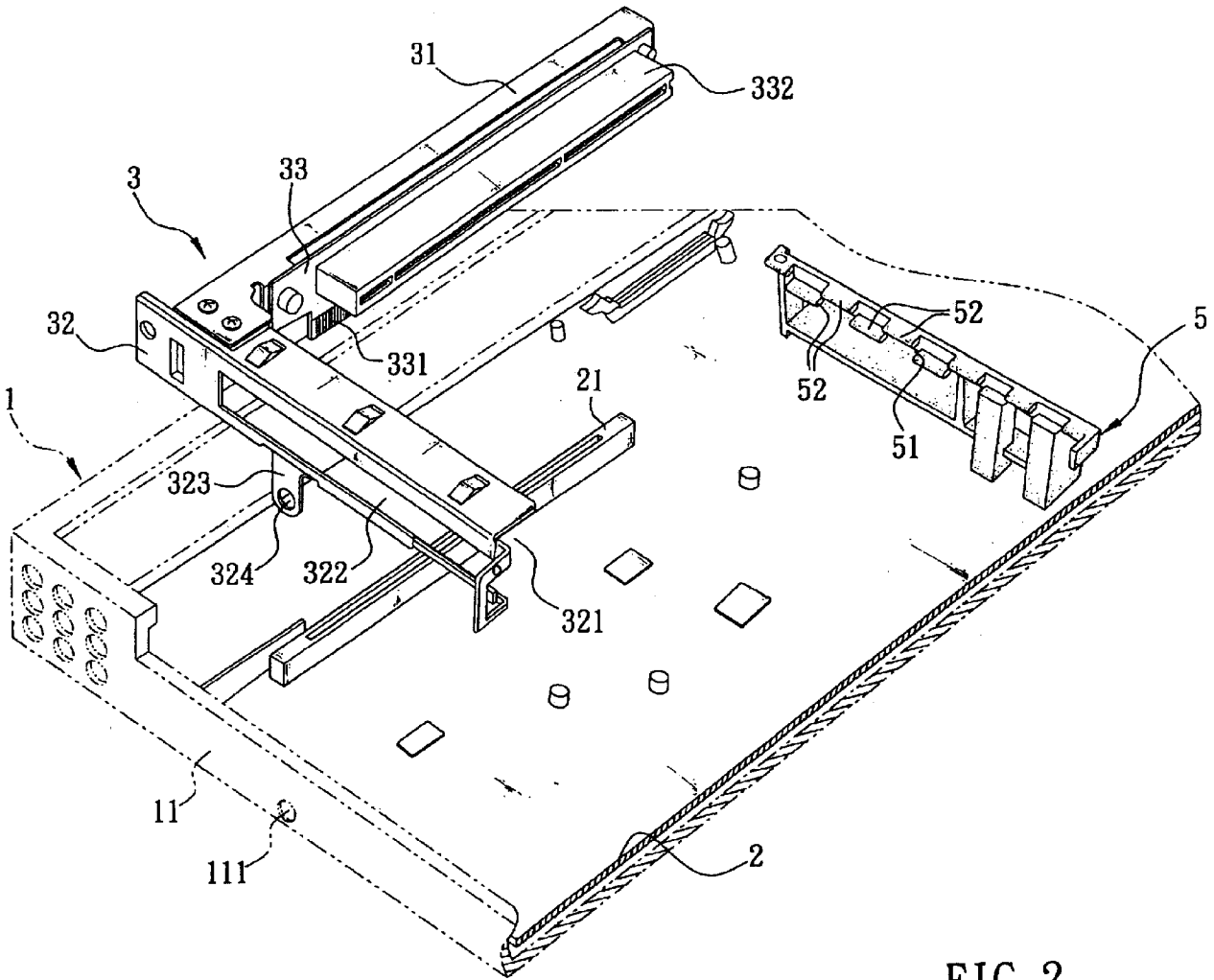
FIG. 2 is an exploded view of a fastening mechanism for adapter card according to the invention.

Referring to FIG. 2, there is shown a fastening mechanism for adapter card in accordance with the invention. Component of the fastening mechanism will be described in detail below. A computer case 1 has an expansion plate 11 at one side. A motherboard 2 is provided in the case 1. The motherboard 2 comprises at least one expansion slot 21 each being disposed perpendicular to the expansion plate 11. An L-shaped snapping frame 3 consists of a connection seat 31 and a fastening seat 32 perpendicular to the connection seat 31. The connection seat 31 is parallel with the slot 21. A signal adapter board 33 is formed on the connection seat 31. The signal adapter board 33 has a leg 331 at one side. The leg 331 is extended downward to be adapted to insert into the slot 21. An adapter slot 332 is formed at the other side of the signal adapter board 33 distal from the leg 331. The adapter slot 332 is parallel with the slot 21. The fastening seat 32 is snapped on the expansion plate 11 together with the expansion plate 11 to form a flat surface. Moreover, an elongated groove is formed along the fastening seat 32. An opening 321 is formed at one end of the fastening seat 32 distal from the connection seat 31 for communicating with the groove. An elongated channel 322 is formed on one side of the fastening seat 32 adjacent the expansion plate 11. The channel 322 is in communication with the groove.

Figure 3:
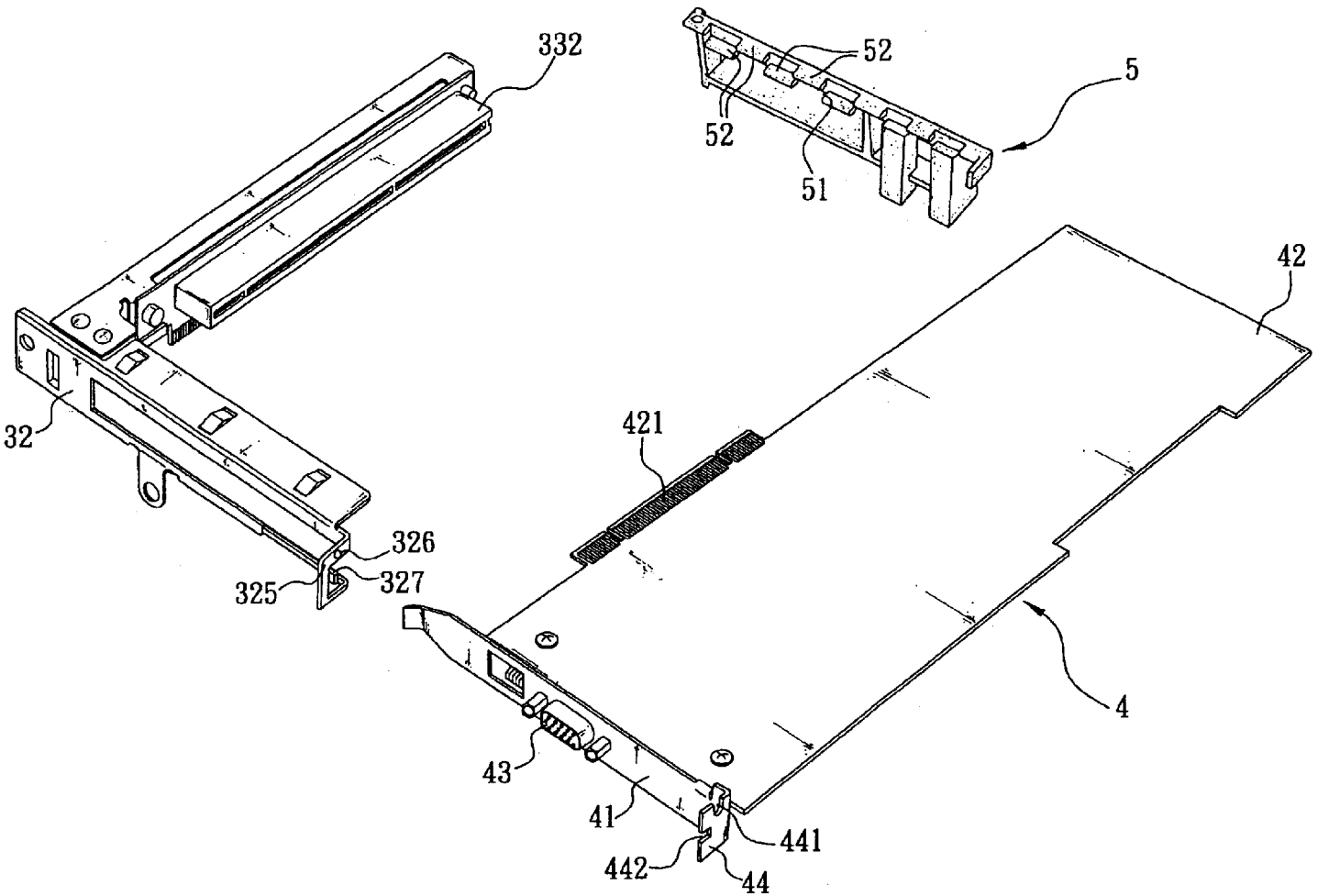
FIG. 3 is an exploded view of the snapping frame, the adapter card, and the support.

Referring to FIG. 3, the typical adapter card 4 comprises a metal bracket 41, a circuit board 42 perpendicular to the bracket 41, the circuit board 42 having a plurality of metal pins 421 projected from one side, the pins 421 being perpendicular to the bracket 41, at least one connector 43 formed on the outer side of the bracket 41, the connector 43 being electrically coupled to the circuit board 42, and a connection member 44 extended from one end of the bracket 41 and bent about 90 degrees with respect to the bracket 41, the connection member 44 having a cavity 441 at one side and an indentation 442 at an adjacent side.

Figure 4:
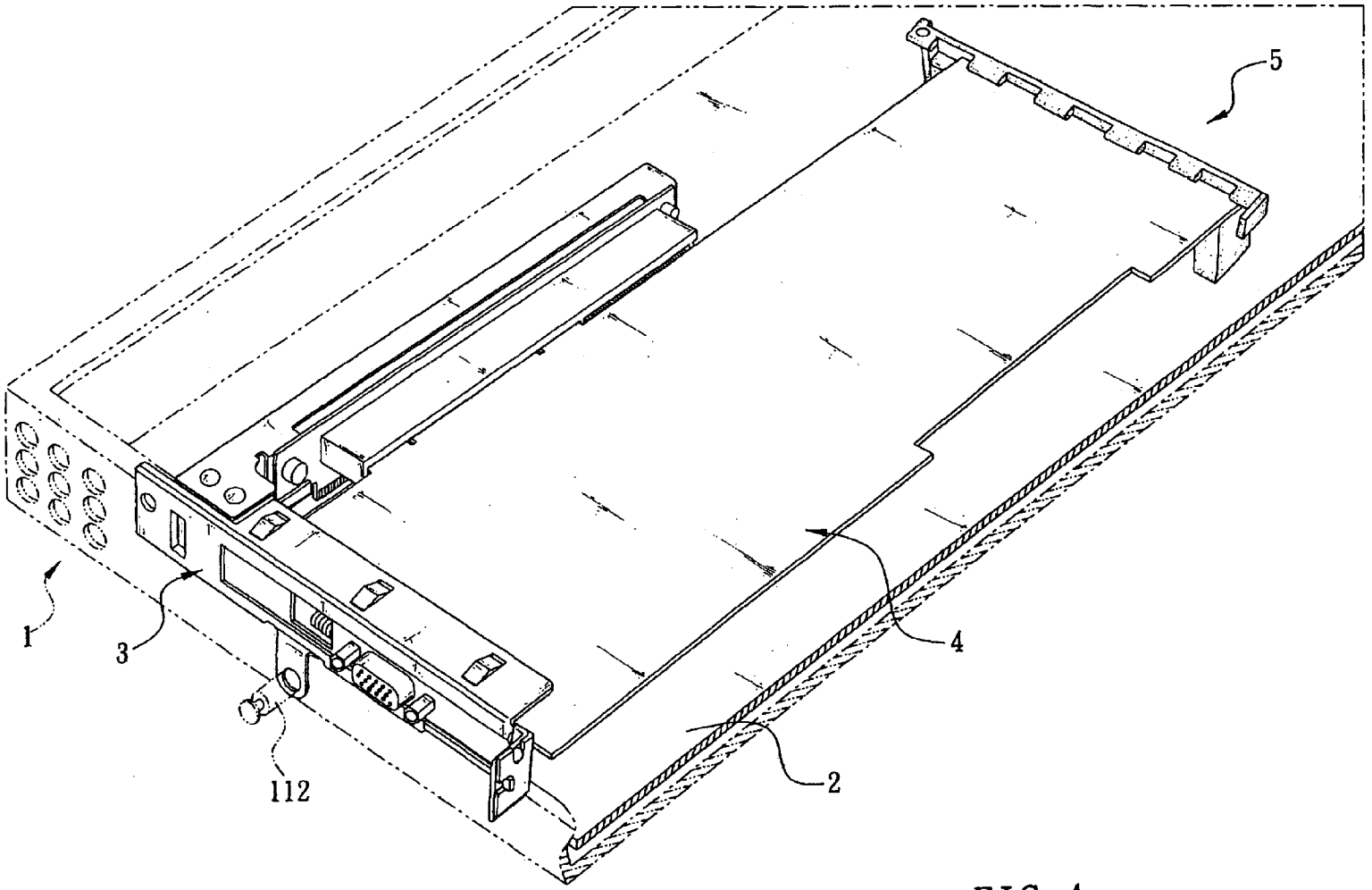
FIG. 4 is a perspective view of the assembled snapping frame, adapter card, and support in a computer case.

Referring to FIGS. 2, 3, and 4, the unique construction of the adapter card 4 and characteristics of the invention will be detailed below. First, push the bracket 41 into the groove by passing the opening 321 until the pins 421 are firmly inserted into the adapter slot 332. As such, signal can be communicated between the adapter card 4 and the motherboard 2. Also, the connector 43 is projected from the channel 322 to expose on the expansion plate 11. Thus, a cable extended from a computer component (e.g., display) can be coupled to the connector 43. To the contrary, in disconnecting the cable from the connector 43 a user can easily, quickly unplug the cable from the expansion plate 11 since the connector 43 is exposed on the adapter slot 332.

Referring to FIGS. 2, 3, and 4, in the invention a tab 323 is projected from the fastening seat 32 adjacent the channel 322. The tab 323 is extended downward toward the expansion plate 11 with a circular hole 324 of the tab 323 is aligned with a threaded hole 111 of the expansion plate 11. As such, a fastener 112 can be employed to drive through the circular hole 324 and the threaded hole 111 for fastening the snapping frame 3 in the case 1.

Referring to FIGS. 2, 3, and 4, in the invention an elongated support 5 is provided on the motherboard 2. The support 5 corresponds to the fastening seat 32. The support 5 comprises a fastening trough 51 at a distal side from the motherboard 2, the fastening trough 51 including a plurality of alternate short protrusions 52 at both top and bottom sides. As such, one end of the circuit board 42 is inserted into the fastening trough 51 when the bracket 41 is inserted in the groove. This arrangement can provide an enhanced fastening of the adapter card 4 in the motherboard 2.

Referring to FIGS. 2, 3, and 4, in the invention a bent member 325 is extended from one end of the fastening seat 32 adjacent the opening 321 and is bent about 90 degrees with respect to the fastening seat 32. A protuberance 326 and a latch arm 327 are formed on the bent member 325. As such, the protuberance 326 is in the cavity 441 and the latch arm 327 is in the indentation 442 when the pins 421 are firmly inserted into the adapter slot 332 in response to pushing the bracket 41 into the groove. As an end, the fastening of the adapter card 4 in the snapping frame 3 is further enhanced.

In brief, the invention involves a parallel arrangement of the adapter cards 4 with respect to the motherboard 2 in installing the adapter cards 4 in the computer case 1 for greatly reducing the size of the computer case 1. Moreover, a user can easily, quickly, and conveniently unplug a cable from the expansion plate 11 since the connector 43 is exposed on the expansion plate 11. Importantly, the invention can contribute great to vast computer consumers. More importantly, computer manufacturers can make the invention as a means for surviving in the competitive information product market.

While the invention has been described by means of specific embodiments, numerous modifications and variations could be made thereto by those skilled in the art without departing from the scope and spirit of the invention set forth in the claims.

What is claimed is:

1. A mechanism for fastening an adapter card in a computer case, comprising:

an expansion plate at one side of the computer case;

a motherboard in the computer case, the motherboard including at least one expansion slot each being disposed perpendicular to the expansion plate; and an L-shaped snapping frame including a connection seat and a fastening seat perpendicular to the connection seat, the connection seat being parallel with the expansion slot, the connection seat including a signal adapter board including a leg at one side, the leg being extended downward to insert into the expansion slot, and an adapter expansion slot at the other side of the signal adapter board distal from the leg, the adapter expansion slot being parallel with the expansion slot, wherein the fastening seat is snapped on the expansion plate together with the expansion plate to form a flat surface, and the fastening seat comprises an lengthwise groove, an opening at one end distal from the connection seat, the opening being in communication with the groove, and an elongated channel on one side adjacent the expansion plate, the channel being in communication with the groove.

2. The mechanism of claim 1, wherein the adapter card comprises a bracket, a circuit board perpendicular to the bracket, the circuit board having a plurality of metal pins projected from one side, the pins being perpendicular to the bracket, at least one connector on an outer side of the bracket, the connector being electrically coupled to the circuit board, and a connection member extended from one end of the bracket and being perpendicular with respect to the bracket, the connection member having a cavity and an indentation.

3. The mechanism of claim 2, wherein further comprising an elongated support on the motherboard, the support being adapted to correspond to the fastening seat, the support including a fastening trough at a distal side from the motherboard, the fastening trough including a plurality of alternate short protrusions at both top and bottom sides thereof so that one end of the circuit board is inserted into the fastening trough when the bracket is inserted in the groove.

4. The mechanism of claim 2, wherein the expansion plate comprises a threaded hole and the fastening seat further comprises a projected tab adjacent the channel, the tab including a circular hole, the tab being extended downward toward the expansion plate to align the circular hole aligned with the threaded hole so that the snapping frame can be fastened in the computer case by driving a fastener through the circular hole and the threaded hole.

5. The mechanism of claim 2, wherein the fastening seat further comprises a bent member extended from one end adjacent the opening and being perpendicular with respect to the fastening seat, the bent member including a protuberance and a latch arm so that the protuberance is in the cavity and the latch arm is in the indentation when the pins are firmly inserted into the adapter expansion slot in response to pushing the bracket into the groove.

* * * * *